US009051112B2

(12) United States Patent
Sanger

(10) Patent No.: US 9,051,112 B2
(45) Date of Patent: Jun. 9, 2015

(54) CONTAINER HAVING PADDED DUNNAGE SUPPORTS AND L-SHAPED TRACKS

(71) Applicant: Bradford Company, Holland, MI (US)

(72) Inventor: Matthew S. Sanger, West Olive, MI (US)

(73) Assignee: Bradford Company, Holland, MI (US)

( * ) Notice: Subject to any disclaimer, the term of this patent is extended or adjusted under 35 U.S.C. 154(b) by 110 days.

(21) Appl. No.: 14/038,921

(22) Filed: Sep. 27, 2013

(65) Prior Publication Data

US 2015/0090722 A1 Apr. 2, 2015

(51) Int. Cl.

| | |
|---|---|
| ***B65D 88/54*** | (2006.01) |
| ***B65D 90/12*** | (2006.01) |
| *B65D 81/07* | (2006.01) |
| *B65D 25/10* | (2006.01) |
| *B65D 81/02* | (2006.01) |

(52) U.S. Cl.

CPC ..... *B65D 88/546* (2013.01); *B65D 90/12* (2013.01); *B65D 2585/6882* (2013.01); *B65D 81/07* (2013.01); *B65D 25/10* (2013.01); *B65D 81/02* (2013.01)

(58) Field of Classification Search

CPC ..... B65D 81/07; B65D 81/05; B65D 81/02; B65D 25/06; B65D 25/10; B65D 2585/6882; A47B 88/20; A47B 88/12

USPC ..... 206/485; 220/544, 23.88

See application file for complete search history.

(56) References Cited

U.S. PATENT DOCUMENTS

| | | | | |
|---|---|---|---|---|
| 634,589 | A | | 10/1899 | Russell |
| 1,712,168 | A | | 5/1929 | Rand, Jr. |
| 4,105,220 | A | | 8/1978 | Pacific |
| 4,527,694 | A | | 7/1985 | Bolt et al. |
| 4,685,571 | A | | 8/1987 | Hoss |
| 4,721,317 | A | | 1/1988 | Avot |
| 4,770,314 | A | | 9/1988 | Giesler |
| 4,864,686 | A | | 9/1989 | Lasier et al. |
| 4,988,006 | A | | 1/1991 | Lundin |
| 5,238,139 | A | | 8/1993 | Bisceglia |
| 5,324,105 | A | * | 6/1994 | Christensen ..... 312/319.4 |
| 5,407,262 | A | | 4/1995 | Christian et al. |
| 5,560,507 | A | | 10/1996 | Arpin et al. |
| 5,725,119 | A | | 3/1998 | Bradford et al. |
| 5,813,566 | A | | 9/1998 | Bradford et al. |
| 5,815,903 | A | | 10/1998 | Foster et al. |
| 5,887,718 | A | * | 3/1999 | Oslin et al. ..... 206/499 |
| 6,062,410 | A | | 5/2000 | Bradford et al. |
| 6,164,440 | A | | 12/2000 | Van Bree |
| 6,202,884 | B1 | | 3/2001 | Verkerke |

(Continued)

FOREIGN PATENT DOCUMENTS

| | | |
|---|---|---|
| DE | 19549166 | 3/1997 |
| DE | 20101374 | 4/2001 |

(Continued)

*Primary Examiner* — Stephen Castellano

(74) *Attorney, Agent, or Firm* — Wood, Herron & Evans, LLP

(57) ABSTRACT

A container for holding product therein during shipment and being returned for reuse has a base and opposed sides, L-shaped tracks, and a plurality of padded dunnage supports extending between the tracks. One type of padded dunnage support comprises end members and a tubular middle member, the end members being movable along the tracks. The padded dunnage supports support dunnage, such as pouches.

20 Claims, 14 Drawing Sheets

(56) References Cited

U.S. PATENT DOCUMENTS

| | | | | |
|---|---|---|---|---|
| 6,230,916 | B1 | 5/2001 | Bradford et al. | |
| 6,305,764 | B1 | 10/2001 | Kortman et al. | |
| 6,540,096 | B1 | 4/2003 | Bazany et al. | |
| 6,830,156 | B2 | 12/2004 | MacKelvie | |
| 7,125,062 | B2 | 10/2006 | Kiester et al. | |
| 7,748,559 | B2 | 7/2010 | Bradford | |
| 7,762,422 | B2 * | 7/2010 | Dobrinski | 220/544 |
| 8,100,282 | B2 | 1/2012 | Nyeboer et al. | |
| 2006/0249514 | A1 | 11/2006 | Bazany et al. | |
| 2006/0249515 | A1 | 11/2006 | Dobrinski | |
| 2008/0023470 | A1 | 1/2008 | Bradford | |
| 2010/0072206 | A1 | 3/2010 | Doyle | |
| 2013/0057135 | A1 | 3/2013 | Bradford et al. | |

FOREIGN PATENT DOCUMENTS

| | | |
|---|---|---|
| DE | 20318172 U1 | 5/2004 |
| FR | 1455414 | 4/1966 |
| FR | 2860504 | 4/2005 |
| JP | 659230 | 8/1994 |
| WO | 9310024 | 5/1993 |

* cited by examiner

CONTAINER HAVING PADDED DUNNAGE SUPPORTS AND L-SHAPED TRACKS

FIELD OF THE INVENTION

The present invention relates to containers for use in shipping and, more particularly, to containers with movable members for supporting product.

BACKGROUND OF THE INVENTION

A large number of different container structures are utilized by manufacturers to ship a variety of different products to end users, which may be, for example, assembly plants. In the automobile industry, for example, an assembly plant assembling a particular automobile might utilize a number of different parts from different manufacturers. These manufacturers ship their respective parts to the assembly plant in container structures where the parts are then removed from dunnage or support members inside the container structure and assembled into a finished automobile.

Access to the product in the containers is of particular concern. Specifically, in the automotive industry, the containers full of product are positioned on an assembly line adjacent to a work area, which is associated with a particular product to be installed on a manufactured vehicle. For example, a container full of interior door panels is usually positioned next to a particular station on an assembly line where interior door panels are installed so that a line worker may easily access the door panels inside the container. The product or part is taken directly from the container and used on the line. Some existing containers are difficult to access, which makes removal of the parts therein difficult and time-consuming. For example, some containers are configured so that a line worker must walk around the container to remove parts or products from opposite ends of the container. As may be appreciated, a line worker only has a certain amount of time to install a part. Any delay in access and removal of the part from the container is undesirable.

In many containers, a line worker or employee must insert or remove parts from a distal or rear part of the container. The size and/or weight of the parts or workpieces may cause stress or strain on the line worker and, more particularly, on the back of the worker when inserting or removing parts from such a container. Such ergonomically unfriendly movements may cause physical trauma, pain and other injuries that may lead to lost production time.

In some situations, in order to alleviate such stress and/or strain on his or her body, the line worker may move to the rear or opposite end of the container to remove parts from inside the container. This requires space around the container which may not be available, depending on the physical layout of the plant or facility. The length (front to back) of certain containers may be limited because the container manufacturer needs to eliminate the need for a line worker to walk around the container to remove product from inside the container. Such containers having a reduced length reduce the number of parts or products which may be shipped and/or stored in the container. The more containers needed to ship a predetermined number of parts, the greater the cost to the shipper.

In other containers, a line worker or employee must lean forward and bend down into the container to insert or remove a part or workpiece from a lower portion of the container. This movement by the line worker is ergonomically unfriendly because the line worker must lean forward and bend down and lift a part or workpiece up and over a wall into the container to remove the part or workpiece from inside the container. Similarly, when a part or workpiece must be inserted into a container, the line worker may have to lean forward and insert the part, which may be heavy, into its proper location inside the container, again experiencing ergonomically unfriendly movements. Such movements may be necessary with many top loading containers and/or containers having multiple layers or levels of parts.

Depending upon the number of times the line worker repeats this unnatural motion into the interior of the container, strain in the back, legs and arms may result. The size and/or weight of the parts or workpieces may increase the strain on the line worker. Thus, simply removing multiple parts during a work day may cause physical trauma, pain and other injuries that may lead to lost production time.

Accordingly, there is a need for a container which prevents employees from walking around the container to insert or remove product from inside the container.

There is further a need for a container which prevents employees from having to perform difficult or straining repetitive reaching motions.

There is further a need for a container which brings product into an ergonomically friendly area or zone for insertion or removal of the product.

SUMMARY OF THE INVENTION

The present invention provides a container for holding product therein during shipment. The container comprises a base and two opposed sides. The base and sides may be part of a metal frame or part of a plastic pallet box. In one embodiment, at least one of the tracks on each side may be non-linear. For purposes of this document, a non-linear track includes, but is not limited to, a generally L-shaped track and/or a generally C-shaped track and/or a generally J-shaped track and/or a generally U-shaped track. In one embodiment, the container has one non-linear track on each side of the container. However, any number of non-linear tracks may be supported by each side of the container.

Each of the generally L-shaped tracks comprises a generally horizontally oriented portion and a generally vertically oriented portion. The generally vertically oriented portion extends downwardly from the generally horizontally oriented portion.

The container further comprises a plurality of movable padded dunnage supports supported by the tracks. Each padded dunnage support extends between opposed tracks at the same layer or level. For purposes of this document, the term "padded dunnage support" may be a unitary member or multiple components secured together in an assembly. For example, a "padded dunnage support" may comprise in combination a middle member and a pair of end members secured to opposed ends of the middle member along with a cushioning member at least partially surrounding a portion thereof. The end members may move inside or along stationary tracks or track assemblies like those disclosed in U.S. patent application Ser. No. 13/896,675, which is fully incorporated by reference herein. Alternatively, a "padded dunnage support" may comprise a unitary member like those disclosed in U.S. patent application Ser. No. 13/225,835, which is fully incorporated by reference herein, surrounded at least partially by a cushioning member.

For purposes of the present invention, the term "track" may be a unitary member or multiple components secured together. The present invention is not intended to be limited to the tracks like those illustrated and described herein. For example, a "track" may comprise a rail attached to one or more walls of a container. The term "track" is intended to include any number of stationary objects along which dunnage supports, as defined and/or illustrated herein, may slide or move during the loading or unloading of product from dunnage inside the container.

The container further comprises dunnage supported by the padded dunnage supports. The dunnage may be pouches or any other known dunnage made of textile fabric or any other known material. The dunnage may be secured to the padded dunnage supports in any known manner, such as sewing.

According to another aspect of the present invention, the container has a base and opposed sides. The base and sides may be part of a metal frame or part of a plastic pallet box. The container further comprises at least one non-linear track supported by each of the opposed sides of the container. In one embodiment, each of the non-linear tracks is generally L-shaped. A plurality of movable padded dunnage supports extend between opposed tracks and move along corresponding tracks. In some embodiments, each of the padded dunnage supports comprises a pair of end members movable along the tracks and a middle member extending between the end members, the middle member being secured to each end member and being at least partially surrounded by a cushioning "noodle" or member. Each of the padded dunnage supports comprises an outer cushion or padding layer to protect products being stored or shipped in the dunnage. Pouches may be wrapped around the padded dunnage supports and supported by the padded dunnage supports.

The container may be adapted so that an operator located at the front of the container may pull product to be emptied from the rear of the container forwardly to a more ergonomically friendly position after products suspended from dunnage at the front of the container have been unloaded or removed. Thus, a person unloading the container from the front or proximal location of the container will not have to stretch or reach to the back of the container to unload remaining product.

Similarly, a person loading the container from the front of the container need not stretch or reach to the back of the container to insert or load product into the container. The loader of the container may push the padded dunnage supports and associated dunnage loaded with product rearwardly and load additional product in a more ergonomically friendly position or manner. For example, after product is loaded into dunnage suspended by adjacent padded dunnage supports, these padded dunnage supports and associated dunnage are pushed rearwardly to enable the loader to load additional product. Thus, the container allows product to be more efficiently and safely removed from the container or inserted therein without unnecessary stress or strain on the operator.

The end members of the padded dunnage supports may be made of plastic or any other desired material. Each side of the container has at least one non-linear track along which the padded dunnage supports move to move dunnage supported by the padded dunnage supports closer to the user for loading or unloading product. Each end member may have at least one head located inside the interior of the track so the end member remains engaged with the track. The end member may have another head outside the track for preventing the dunnage material from entering the interior of the track.

The tracks may have openings therein and removable caps for covering and/or closing the openings. If one or more of the padded dunnage supports needs to be removed or inserted, a person may remove and/or insert one or more padded dunnage support via the openings in opposed tracks.

The ease of operation and other objects and advantages of the present invention shall be made apparent from the accompanying drawings and the brief description thereof.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

DETAILED DESCRIPTION OF THE INVENTION

Figure 1:
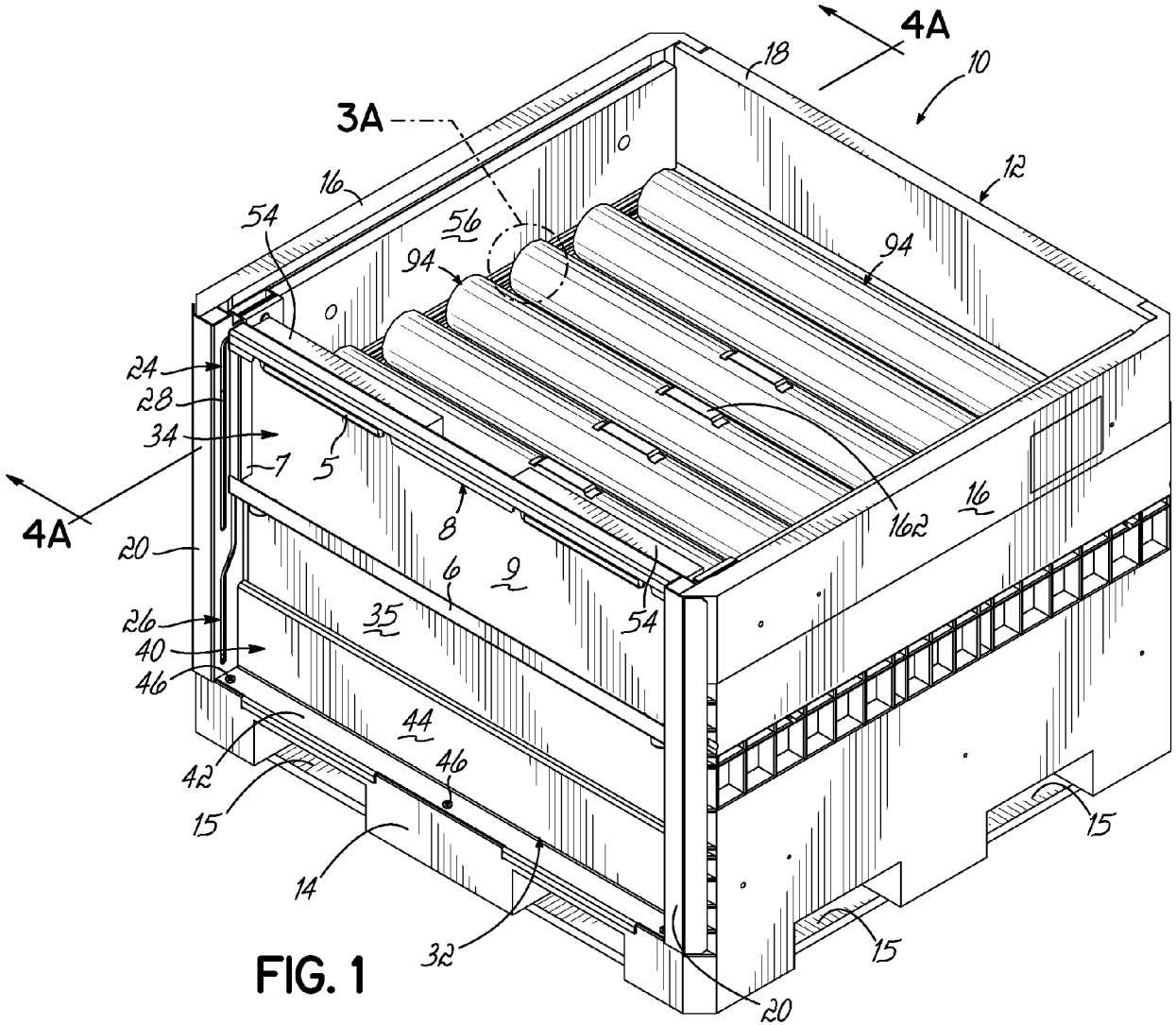
FIG. 1 is a perspective view of one embodiment of a reusable and returnable container.

Referring to FIG. 1, there is illustrated a reusable and returnable container 10 according to one embodiment. The reusable and returnable container 10, as shown, comprises a body 12 having a base 14, opposed sides 16 and a rear 18, all extending upwardly from the base 14. The sides 16 and rear 18 may be hingedly secured to the base 14. The base 14 may have a plurality of passages 15 therethrough adapted to receive the prongs of a forklift for purposes of lifting and moving the container 10. Although one configuration of body in the form of a pallet box is illustrated, the present invention may be used with other types or configurations of container bodies.

Figure 2A:
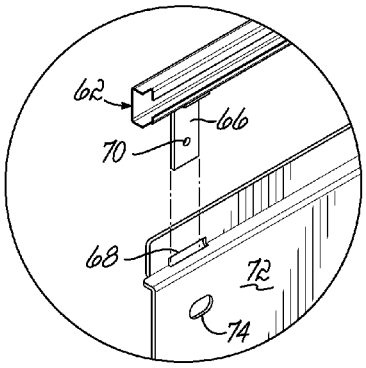
FIG. 2A is an enlarged perspective view of a portion of the container of FIG. 1 without the dunnage and padded dunnage supports.
Figure 2B:
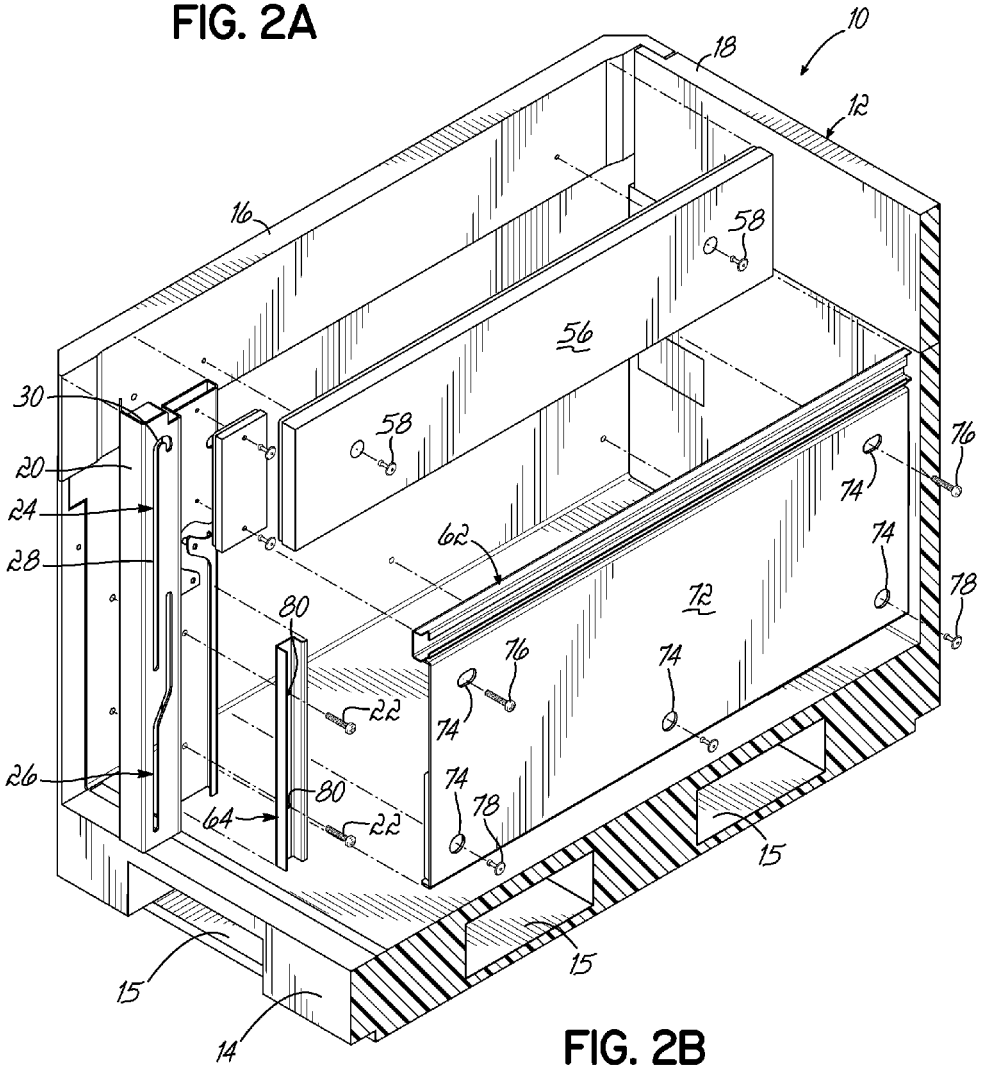
FIG. 2B is a cross-sectional view of a portion of the container of FIG. 1 without the dunnage and padded dunnage supports.

As best shown in FIG. 2B, container 10 further comprises two guide members 20 (only one being shown in FIG. 2). One guide member 20 is fixedly secured to each of the container sides 16 with fasteners 22. Each of the guide members 20 has two slots therethrough, an upper slot 24 and a lower slot 26. As best shown in FIG. 2B, upper slot 24 has a "candy cane" shape comprising a straight portion 28 and a curved upper portion 30. These upper and lower slots 24, 26 are used to secure a movable door assembly 32 in a fixed position and guide the door assembly 32 during its movement from an upper or raised position shown in FIGS. 1 and 4A and a lower or dropped position shown in FIG. 4B. As best shown in FIG. 1, the upper segment 34 of door assembly 32 comprises an upper piece 5 which may function as a handle, a lower piece 6 and two side pieces 7 joined together to create a rectangular frame 8 inside which is a door panel 9. In one embodiment, the door panel 9 is made of plastic and the frame 8 made of metal. However, any desired materials may be used.

As shown and described in pending U.S. patent application Ser. No. 13/896,675 and pending U.S. patent application Ser. No. 13/975,682, each application of which is fully incorporated herein, the door assembly 32 may comprise one or more movable segments. Although the drawings show a door assembly 32 having a movable upper segment 34 and a movable lower segment 35 which are not connected together, any of the door assemblies disclosed in pending U.S. patent application Ser. No. 13/896,675 or pending U.S. patent application Ser. No. 13/975,682 may be incorporated into a container in accordance with the present invention.

Figure 4A:
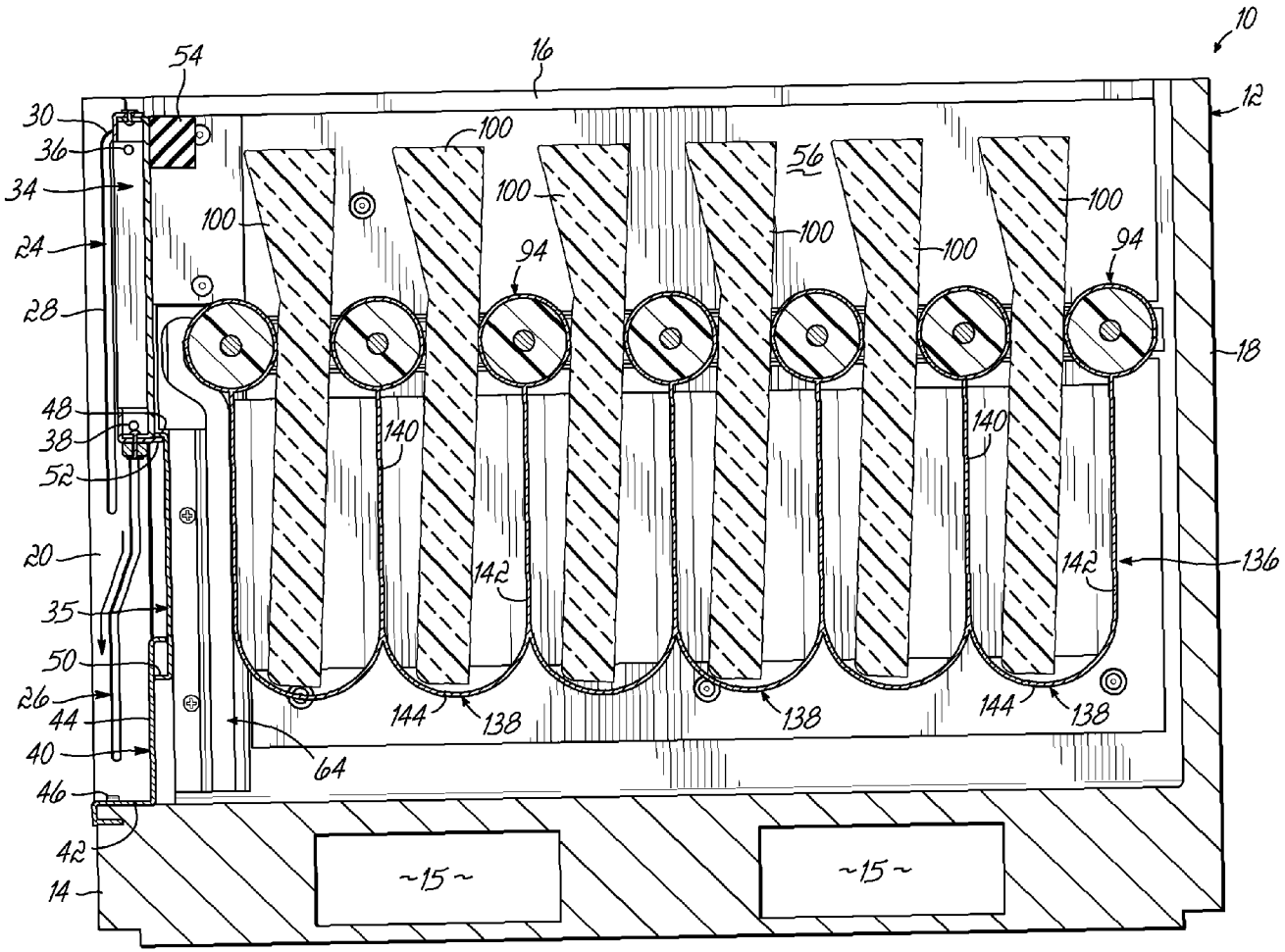
FIG. 4A is a cross-sectional view taken along the line 4A-4A of FIG. 1.

As shown in the drawings, the movable upper segment 34 of door assembly 32 has a pair of upper pins 36, one on each side (only one being shown) extending outwardly from the movable upper segment 34 of door assembly 32 and adapted to ride or move inside the upper slots 24. Similarly, the movable upper segment 34 of door assembly 32 has a pair of lower pins 38 extending outwardly from the movable upper segment 34 of door assembly 32, one on each side (only one being shown). These lower pins 38 are adapted to ride or move inside the lower slots 26. FIG. 4A shows the movable upper segment 34 of door assembly 32 locked in a raised position with the upper pins 36 located at the outer ends of the curved portions 30 of the upper slots 24. As the movable upper segment 34 of door assembly 32 is lowered, it moves outside a stationary shield 40. As best shown in FIGS. 1 and 4A, the stationary shield 40 has a flange 42 and a main portion 44. The flange 42 of the stationary shield 40 is secured with fasteners 46 to the container's base 14.

The lower movable segment 35 of door assembly 32 is not fastened or secured to any particular piece and is free floating between the stationary shield 40 and the movable upper segment 34 of door assembly 32. As best shown in FIG. 4A, movable lower segment 35 of door assembly 32 is generally C-shaped in cross-section, having an outwardly directed upper flange 48 located at the upper end of the movable lower segment 35 and a lower flange 50 located at the lower end of the lower segment 35. The movable lower segment 35 of door assembly 32 moves inside a stationary vertically oriented main portion 44 of the stationary shield 40. As the movable upper segment 34 of door assembly 32 is lowered, the movable lower segment 35 of door assembly 32 moves inside the main portion 44 of the stationary shield 40. As the movable upper segment 34 of door assembly 32 is raised, the flange 52 of the movable upper segment 34 of door assembly 32 contacts the upper flange 48 located at the upper end of the lower segment 35 and raises the floating lower segment 35 of door assembly 32.

Figure 4B:
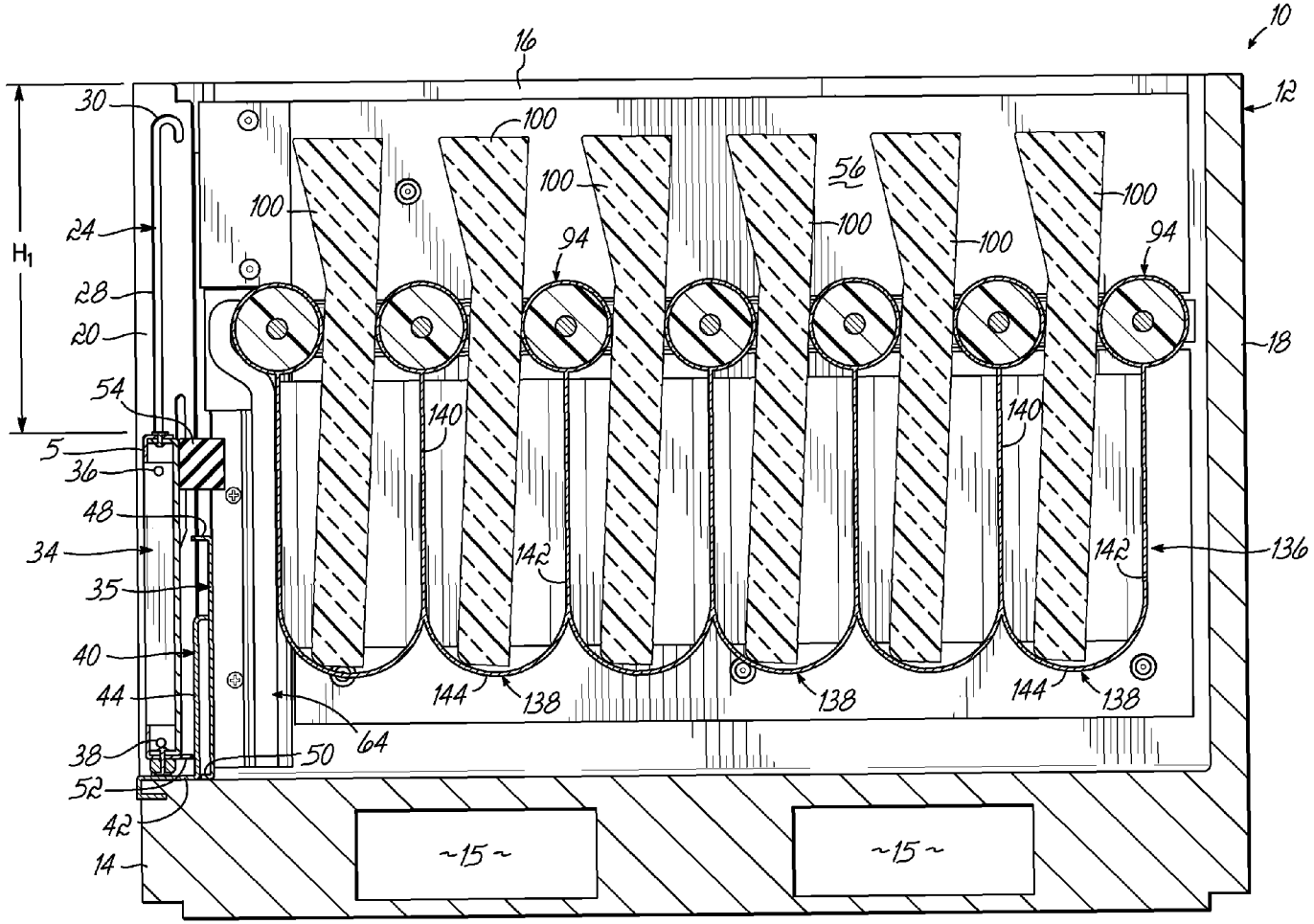
FIG. 4B is a cross-sectional view of a portion of the container of FIG. 1, showing the door assembly in a lowered position.

As shown in FIG. 4B, when the door assembly 32 is in its lowered position an opening having a height $H_1$ is created above the door assembly 32. The height $H_1$ of the opening is greater than half the height of the container, making it desirable from an ergonomic standpoint for the loader/unloader.

As best shown in FIGS. 1 and 4A, multiple protective bumpers 54, may be secured to upper segment 34 of door assembly 32. The bumpers 54 may be made of foam or any other suitable material. When the door assembly 32 is in its lowered position shown in FIG. 4B, the bumpers 54 may function to prevent products 100 from hitting the door assembly 32 during the loading or unloading process. Although two bumpers 54 are illustrated secured to the upper segment 34 of door assembly 32, a continuous bumper or a different number of bumpers may be utilized of any desired configuration or size. If desired, bumpers 54 may be omitted.

Figure 2C:
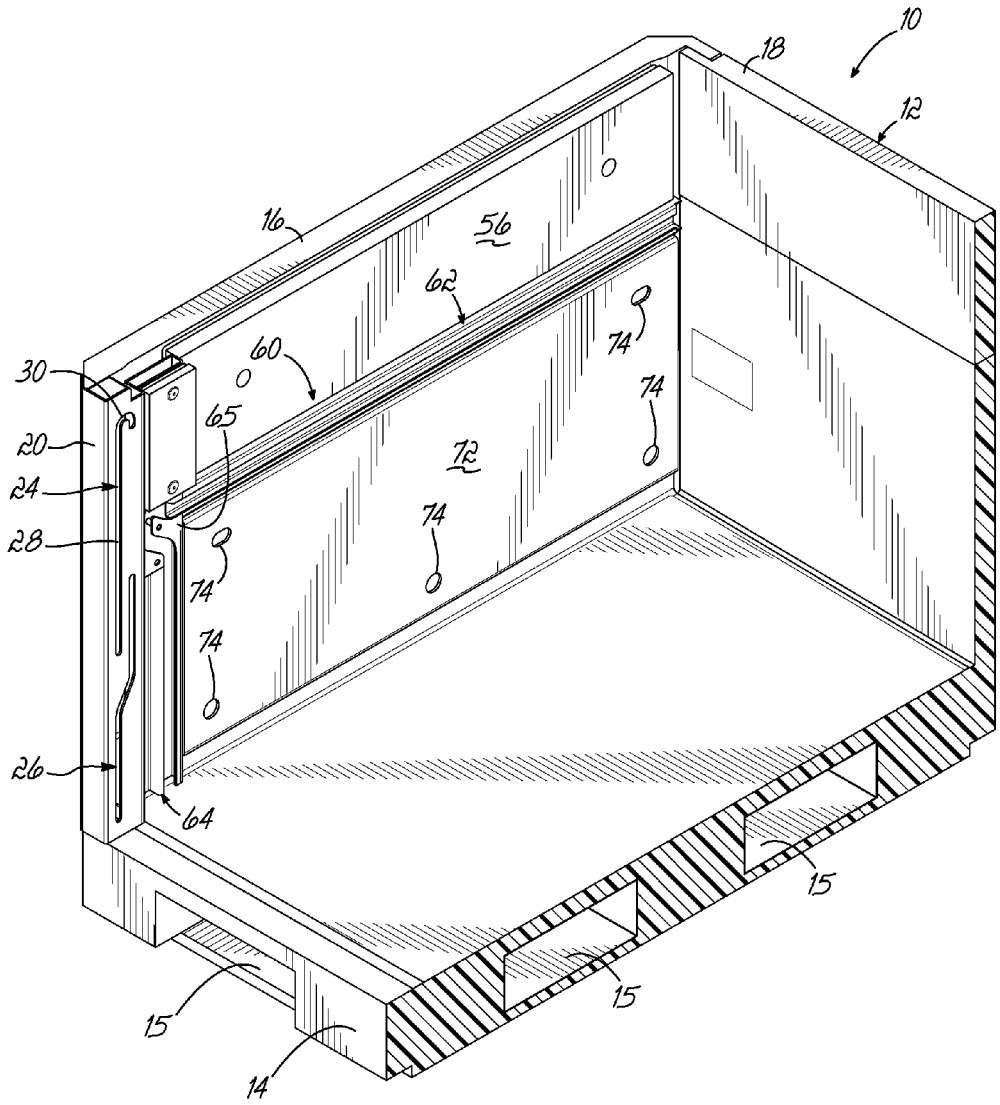
FIG. 2C is a cross-sectional view of a portion of the container of FIG. 1 without the dunnage and padded dunnage supports.

As shown in FIGS. 2B and 2C, a protector 56 may be secured to each of the sides 16 (only one being shown) with fasteners 58. Each protector 56 prevents products 100 from contacting the container sides 16 and being scratched or damaged. The protectors 56 may be made of foam or any other suitable cushioning material. If desired, protectors 56 may be omitted.

As shown in FIG. 2C, a stationary generally L-shaped track 60 is supported by each side 16 of the container 10. Each generally L-shaped track comprises a generally horizontally oriented track portion 62 and a generally vertically oriented track portion 64, each portion 62, 64 being fixedly secured to a side 16 of the container 10.

As shown in FIG. 2A, the generally horizontally oriented track portion 62 has a pair of tabs 66 extending downwardly from the track portion 62 (only one being shown). Each tab 66 extends through a slot 68 in a wall protector 72 and has an opening 70 extending through the tab 66. When the tabs 66 are passed through the slots 68, the openings 70 in tabs 66 align with openings 74 in the wall protector 72. Each fastener 76 extends through an opening 74 in the wall protector 72, through an opening 70 in one of the tabs 66 and into the side 16 of container 10 to secure the wall protector 72 and generally horizontally oriented track portion 62 to the side 16 of the container. In addition, additional fasteners 78 secure a lower portion of the wall protector 72 to the container side 16.

As best shown in FIG. 2B, to secure the generally vertically oriented track portion 64 of generally L-shaped track 60 to the container side 16, fasteners 22 extend through openings 80 in the track portion 64, through a portion of a guide member 20 and into a container side 16.

Figure 3A:
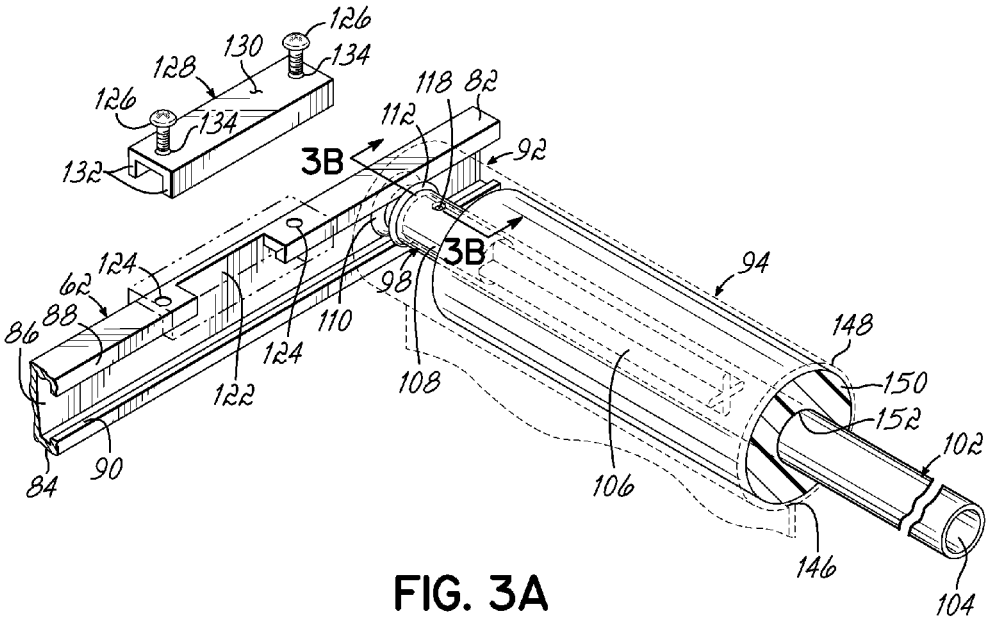
FIG. 3A is an enlarged view of the encircled area 3A of FIG. 1.

As best shown in FIG. 3A, the generally horizontally oriented track portion 62 of generally L-shaped track 60 has an upper wall 82, a lower wall 84 joined to the upper wall 82 by a side wall 86, and a lip 88 extending downwardly from the upper wall 82 and another lip 90 extending upwardly from the lower wall 84 defining an interior 102 of the generally horizontally oriented track portion 62 of generally L-shaped track 60.

Figure 4C:
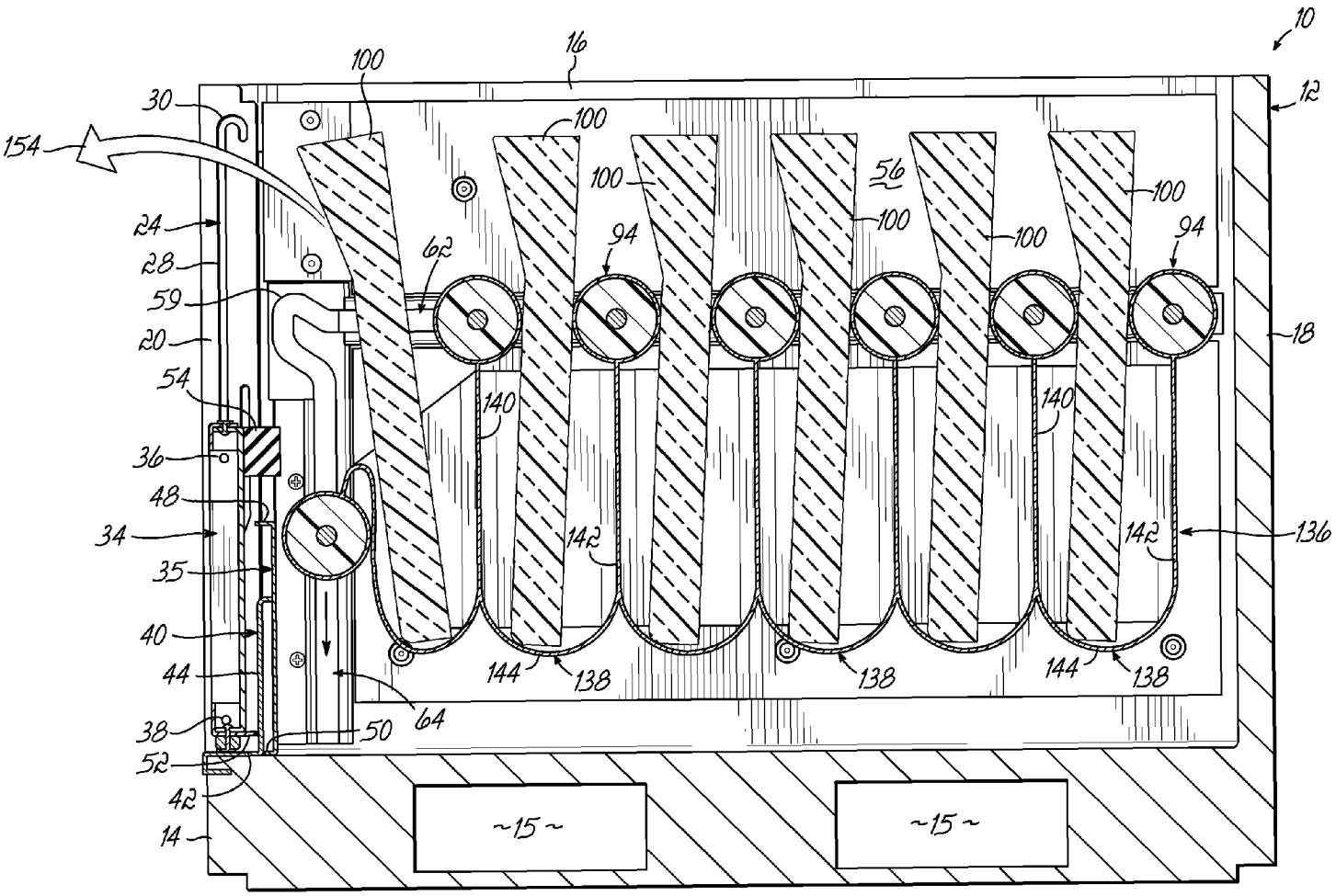
FIG. 4C is a cross-sectional view of a portion of the container of FIG. 1, showing a front product being removed.

As best shown in FIG. 2C, generally vertically oriented track portion 64 and generally horizontally oriented track portion 62, each being fixedly secured to one of the sides 16, do not move after the container 10 is assembled and do not move relative to the sides 16 of the container 10 during the loading or unloading of parts or product. On each side of the container, the top of the generally vertically oriented track portion 64 may connect or communicate with the front end of the generally horizontally oriented track portion 62 at corner 65. The generally vertically oriented track portion 64 may be the same construction and/or material as the horizontally oriented track portion 62, or they may be slightly different. The interior 92 of the generally horizontally oriented track portion 62 connects with the interior of the generally vertically oriented track portion 64 so that one of the padded dunnage supports 94 may move along a continuous path in both a horizontal and vertical direction. The generally horizontally oriented track portion 62 and generally vertically oriented track portion 64 may be separate pieces welded or joined together, or may be a unitary generally "L-shaped" piece of track fixedly secured to each of the container sides 16. In either event, a corner piece (not shown) may be welded or otherwise secured to each corner 65 to prevent the end members or portions of the padded dunnage supports 94 from coming out of the tracks at the corner. As best shown in FIG. 4C, the generally horizontal portion 62 of the generally L-shaped track 60 has an inhibitor, bump or curved portion 59 located at the intersection of the generally horizontal track portion 62 and generally vertically oriented track portion 64 to maintain the padded dunnage supports 94 in positions extending between the generally horizontal track portions 62 of the generally L-shaped tracks 60, as shown in FIG. 2.

Referring to FIG. 1, container 10 further comprises a plurality of padded dunnage supports 94 extending between the tracks 60 on opposed sides of the container. When the container 10 is fully loaded with product, as shown in FIG. 4A, each padded dunnage support 94 extends between the generally horizontally oriented track portions 62 of generally L-shaped tracks 60 at the same level on opposed sides of the container. At the corner of each generally L-shaped track 60 is an inhibitor or curved portion 59 which aids in maintaining the padded dunnage supports 94 in positions extending between the generally horizontally oriented track portions 62 of generally L-shaped tracks 60.

As shown in FIG. 3A, padded dunnage support 94, along with each of the other padded dunnage supports, includes a pair of end members 98 and a tubular support or middle member 102 having a hollow interior 104 extending therebetween. The end members 98 are preferably made of injection molded plastic, such as nylon, but may be made of any other material. The tubular support 104 is preferably made of metal, but may be made of other suitable material, such as plastic.

Figure 3B:
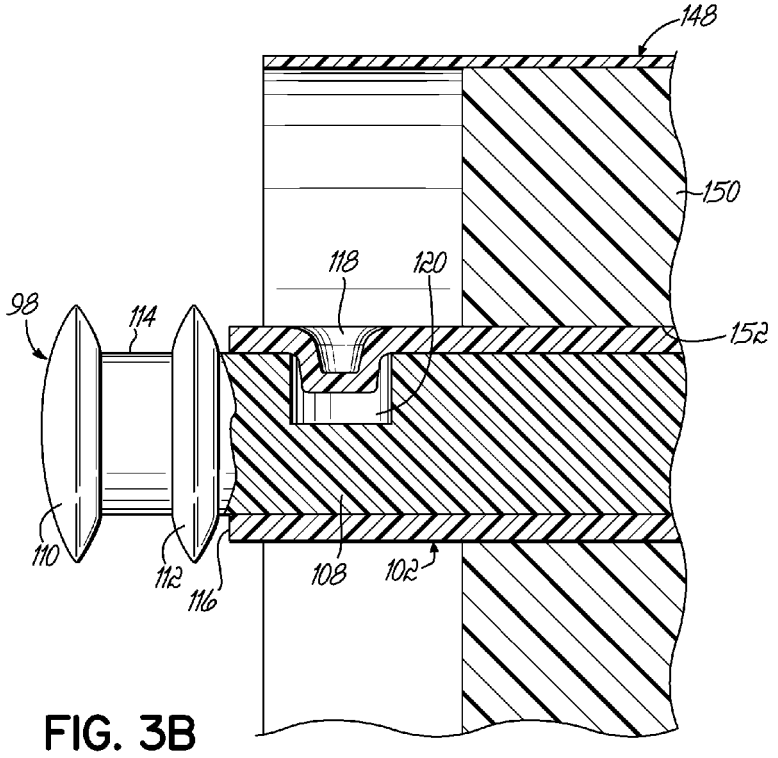
FIG. 3B is a cross-sectional view taken along the line 3B-3B of FIG. 3A.

As shown in FIG. 3A, each end member 98 preferably has a first portion 106 having an X-shaped cross-sectional configuration and a second portion 108 having a circular cross-sectional configuration. Although one configuration of end member 98 is illustrated, any type or configuration of end member may be used with the present invention. In this embodiment, each end member 98 has a pair of heads 110, 112 at the end of the end member 98. As best shown in FIG. 3B, head 110 is furthest from the first portion 106 of the end member 98, and head 112 is spaced inwardly from head 110. The heads 110, 112 are spaced from one another to define a groove 114 therebetween which receives and retains the lips 88, 90 of either the generally horizontally oriented track portion 62 of generally L-shaped track 60 or the generally vertically oriented track portion 64 of generally L-shaped track 60. As shown in FIG. 3A, head 110 is located inside the interior 92 of the generally horizontally oriented track portion 62 of generally L-shaped track 60 or the interior of generally vertically oriented track portion 64 of generally L-shaped track 60. Head 112 is located outside the interior 92 of the generally horizontally oriented track portion 62 of generally L-shaped track 60 or the interior of generally vertically oriented track portion 64 of generally L-shaped track 60. Head 110 keeps the end member 98 engaged with the track, while head 112 keeps the dunnage material out of the interior 92 of the track, thereby ensuring that the end members 98 may move smoothly along either the generally horizontally oriented track portion 62 of generally L-shaped track 60 or the interior of generally vertically oriented track portion 64 of generally L-shaped track 60. Although one configuration of padded dunnage support is illustrated, the present invention may be used with any type or configuration of dunnage support for supporting dunnage so the dunnage may slide or move inside the container.

As shown in FIG. 3B, each end of tubular support 102 fits over at least one portion 108 of an end member 98. An end surface 116 of tubular support 102 abuts head 112 of end member 98. Each end member 98 of each padded dunnage support 94 is adapted to engage and move along one of the tracks. The end members 98 preferably slide along the length or width of the tracks; however, different end members may rotate rather than slide along the tracks. Although one configuration of track and end member is shown and described, other types of end members and tracks may be used if desired. For example, the one-piece dunnage supports and tracks disclosed in U.S. patent application Ser. No. 13/225,835, which is fully incorporated by reference herein, may be used.

As best shown in FIG. 3B, padded dunnage support 94, along with each of the other padded dunnage supports, includes a pair of end members 98 (only one being shown in FIG. 3B). Each end member 98 has a groove 120 formed in a portion 108 therein. Padded dunnage support 94, along with each of the other padded dunnage supports, further includes a tubular support 102 having a hollow interior 104 extending therebetween. As shown in FIG. 3A, each end of tubular support 98 fits over at least one portion 106 of an end member 98. An end surface 116 of tubular support 102 abuts head 112 of end member 98. As shown in FIG. 3B, tubular support 102 has two detents 118 therethrough (one at each end) in which the material of the tubular support 102 is pressed downwardly into the groove 120. This attachment between each of the two end members 98 and the tubular support 102 enables some movement therebetween. Such interaction between the end members 98 and tubular support 102 allows for a tolerance of approximately one-quarter inch on each side. The detents 118 prevent separation of the tubular support 102 from the end members 98 while allowing some movement therebetween as the detents 118 move within the grooves 120 formed in the end members 98.

As best illustrated in FIG. 3A, a cushioning cylinder, sleeve or "noodle" 150 at least partially surrounds the tubular support or middle member 102 of the padded dunnage support 94. The cushioning cylinder 150 is preferably made of polyethylene foam, but may be made of any desirable cushioning or padding material. Each cushioning cylinder 150 may have a central opening 152 extending along its longitudinal axis through which one of the tubular supports 102 passes. In one embodiment, each cushioning cylinder 150 has a diameter of 3.5 to 4.0 inches. However, any sized cushioning cylinder may be used for any particular design. One purpose of the cushioning cylinders 150 is to protect the parts inside the dunnage from contacting each other and damaging each other during shipment as well as during the loading and/or unloading processes. The padded dunnage supports 94 prevent part-to-part contact during shipment by increasing the spacing between adjacent padded dunnage supports 94 and thus increasing the spacing between the parts 100. With parts having a unique configuration such spacing may be necessary to avoid part-to-part contact and resulting damage to the parts during shipment. One such part may have an upper portion wider than its lower portion, as shown generally in the drawings. Although one configuration of part 100 is illustrated, any of the containers shown or described herein may be used to ship or store other parts having other configurations. The generally horizontally oriented track portions 62 of generally L-shaped tracks 60 are located approximately half way up the sides 16 of container 10 to accommodate parts 100 having an upper portion larger than the part's lower portion. Such a configuration enables the maximum number of parts 100 to fit inside the container 10 without damaging each other during shipment.

FIG. 3A illustrates a padded dunnage support 94 used to support one side of one of the pouches. However, FIG. 3A illustrates another innovative feature or aspect of the invention. The generally horizontally oriented track portion 62 of each generally L-shaped track 60 may have an opening or cut-out 122 formed therein. Holes 124 may be formed in the upper wall 82 of the generally horizontally oriented track portion 62 of generally L-shaped track 60, which are sized and threaded to receive fasteners 126. Although fasteners 126 are illustrated to be screws, they may be any other desirable fastener. A cap 128 may be removably secured to the generally horizontally oriented track portion 62 of generally L-shaped track 60 to cover the opening or cut-out 122 formed in the generally horizontally oriented track portion 62 of generally L-shaped track 60. As best seen in FIG. 3A, cap 128 has a generally inverted U-shaped cross-sectional configuration, including a top portion 130 and side portions 132 extending downwardly from the top portion 130. Holes 134 are formed through the top portion 130 of the cap 128 and sized to receive fasteners 126, as shown in FIG. 3A. The fasteners 126 are adapted to pass through the holes 134 in the cap 128 and into the holes 124 in the upper wall 82 of the generally horizontally oriented track portion 62 of generally L-shaped track 60. Caps of alternative shapes or sizes may be used if desired.

When one of the end members 98 or any part of any of the padded dunnage supports is damaged or needs to be replaced for any reason, one may remove cap 128 after loosening fasteners 126, thereby exposing the opening or cut-out 122 of the generally horizontally oriented track portion 62 of generally L-shaped track 60. The damaged padded dunnage support may then be removed or inserted as necessary to repair or replace the damaged part or parts.

As best shown in FIG. 4A, dunnage 136, in the form of a plurality of pouches 138, is suspended by and supported by a plurality of padded dunnage supports 94. Each pouch 138 has a front wall 140, a rear wall 142 and a bottom 144. In some applications, each pouch 138 may have two side walls extending between the front and rear walls 140, 142. As shown in FIG. 4A, the top of the front wall 140 is attached to one of the dunnage supports 94, and the rear wall 142 is attached to an adjacent dunnage support. Although the dunnage 136, as shown, comprises pouches, the dunnage may assume other shapes or configurations. A pouch 138 is supported by two adjacent dunnage supports. As shown in FIG. 3A, the fabric of the pouch 138 is sewn or otherwise secured together along a seam 146 to make a pocket 148 in which is located a cushioning cylinder 150 surrounding, at least partially, a tubular support 102 of the padded dunnage support. As shown in FIG. 1, a handle 162 may be sewn or otherwise secured to an upper portion of one or more pouches 138 above one or more of the padded dunnage supports 94.

Padded dunnage supports 94 supporting pouches 138 are adapted to move from back to front inside the interior of the container 10, the end members 98 of the padded dunnage supports 94 moving along the stationary tracks 60 in generally horizontal and vertical directions.

Multiple pouches 138 are shown being formed or created from one piece of material draped or laying over and secured to the dunnage supports 94. Alternatively, each pouch 138 may be made from its own piece of material, in which case, the pouches 138 would not be interconnected other than via the straps or space limiters (not shown).

FIGS. 4A-4E illustrate a method of unloading products 100 from the pouches 138 of the container 10. The method comprises the first step of lowering upper door segment 34 and lower door segment 35 of door assembly 32 from a raised and locked position shown in FIG. 4A to a lowered or dropped position illustrated in FIG. 4B. As shown in FIG. 4A, when the door assembly 32 is in its raised and locked position, the front padded dunnage support 94 is prevented from moving through the inhibitor 59 and into the generally vertically oriented track portion 64 of generally L-shaped track 60 by the cushioning cylinder 150 of the front padded dunnage support 94 contacting the upper door segment 34 of door assembly 32. However, when the door assembly 32 is in a lowered position the upper door segment 34 of door assembly 32 does not prevent the front padded dunnage support 94 from moving through the inhibitor 59 and into the generally vertically oriented track portion 64 of generally L-shaped track 60. As shown in FIG. 4B, when the door assembly 32 is in a lowered position, an opening having a height $H_1$ is created above the door assembly 32 to assist an operator in loading and unloading products 100 into and out of pouches. In order to move the door assembly 32 out of its raised and locked position shown in FIG. 4A, an operator must grasp the upper piece or handle 5 of the upper segment 34 of door assembly 32 and lift the door assembly 32 upwardly so the upper pins 36 move upwardly and outwardly, following the path of the curved upper portion 30 of the upper slots 24 of the guide members 20. Once the upper pins 36 of door assembly 32 reach the linear portion 28 of the upper slots 24 of the guide members 20, the door assembly 32 moves further downwardly due in part to gravity, the lower pins 38 traveling along the lower slots 26 of the guide members 20 until the door assembly 32 reaches its open or lowered position shown in FIG. 4B.

As shown in FIG. 4C, with the door assembly 32 in its lowered position, the next step comprises moving the front padded dunnage support 94 forwardly, the end members 98 sliding in the stationary generally horizontally oriented track portions 62, from its position shown in FIG. 4A over the inhibitors or curved portions or bumps 59 and into the generally vertically oriented track portions 64 to a position shown in FIG. 4C. At this point, the product 100 in the forwardmost or front pouch 138 is still in the front pouch 138, as shown in FIG. 4C. As shown in FIG. 3C, the product 100 in the front pouch 138 is then removed by the operator in the direction shown by arrow 154 over the lowered door assembly 32. Thus, the front product 100 being removed passes between the partially lowered or dropped first padded dunnage support 94 and the second padded dunnage support 94, which is still extending between the generally horizontally oriented track portions 62. As shown in FIG. 4C, the lowered position of the door assembly 32 makes it easier from an ergonomic standpoint for the operator to remove the product 100 because the product 100 need not be raised over the full height of the container 10 to be removed from inside the container. As shown in FIG. 4C, when the front padded dunnage support 94 is located extending between the generally vertically oriented track portions 64 of the generally L-shaped tracks 60, and next padded dunnage 94 is located extending between the generally horizontally oriented track portions 62 of the generally L-shaped tracks 60, an operator may easily remove a product 100 inside the front pouch 138 because one padded dunnage support 94 is below the adjacent padded dunnage support 94. This orientation of the padded dunnage supports due to the configuration of the L-shaped tracks 60 helps an operator from an ergonomic standpoint, reducing the stress and strain on the body of the operator when unloading product from the dunnage. Thus, the unique configuration of the upper generally L-shaped tracks 60 inside the container 10 may reduce the container owner's costs because workers or operators may have fewer injuries/days off due to injury.

Figure 4D:
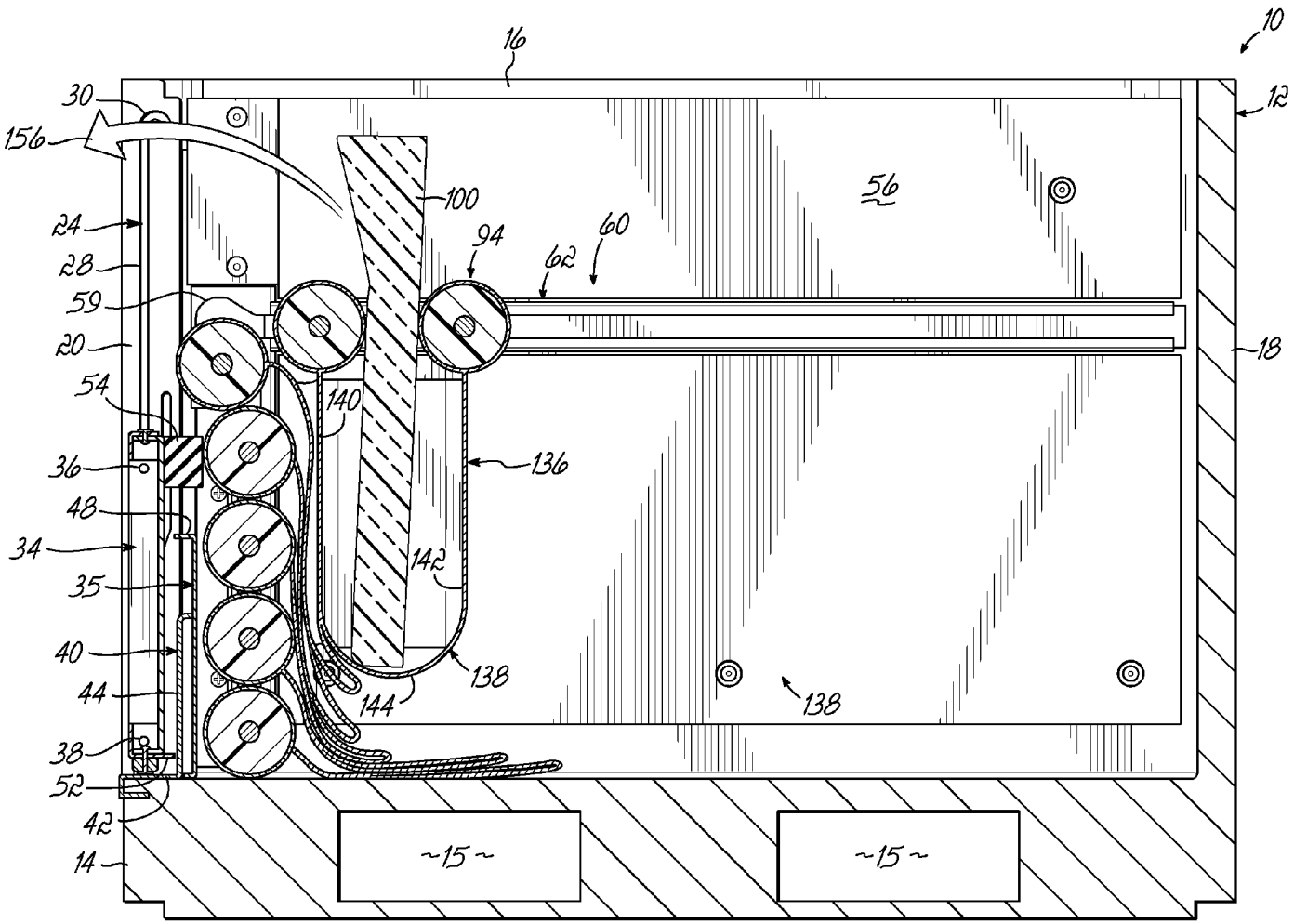
FIG. 4D is a cross-sectional view of a portion of the container of FIG. 1, showing a rear product being removed.

As shown in FIG. 4D, this unloading process is continued by an operator one product at a time until all the last product 100 is removed from the last pouch 138 in the direction of arrow 156. During the process of unloading the last product 100, each of the padded dunnage supports 94, except the last two, extends between the generally vertically oriented track portions 64. Each time a product 100 is removed from a pouch 138, the padded dunnage support 94 and associated dunnage are moved along the generally L-shaped tracks 60 in a generally counter-clockwise direction, as shown in FIG. 4A-4D. During this unloading process, the end members 98 at the ends of the padded dunnage supports 94 move along the generally L-shaped tracks 60.

Figure 4E:
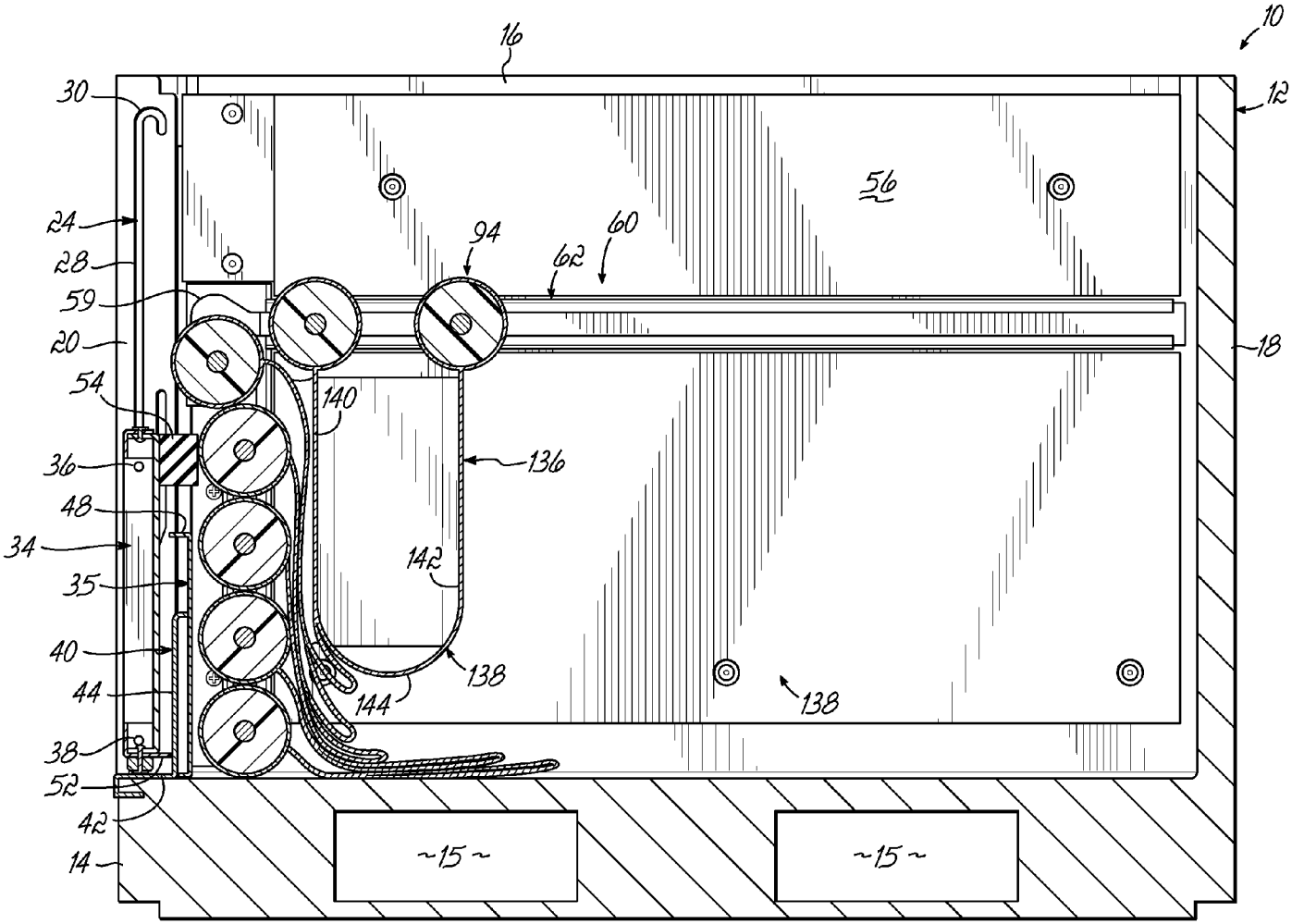
FIG. 4E is a cross-sectional view of a portion of the container of FIG. 1, showing all products removed.

As shown in FIG. 4E, the empty container 10 still having the dunnage therein is then shipped back to its desired location for loading additional product. During the unloading or loading process, the tracks 60 remain stationary fixedly secured to the container sides 16; it is the padded dunnage supports 94 and dunnage hanging from the padded dunnage supports 94 which move inside the container with the assistance of an operator.

FIG. 4E illustrates the empty container 10 still having the dunnage therein, which may then be shipped back to its original location or any desired location for loading the empty dunnage with product.

Figure 5A:
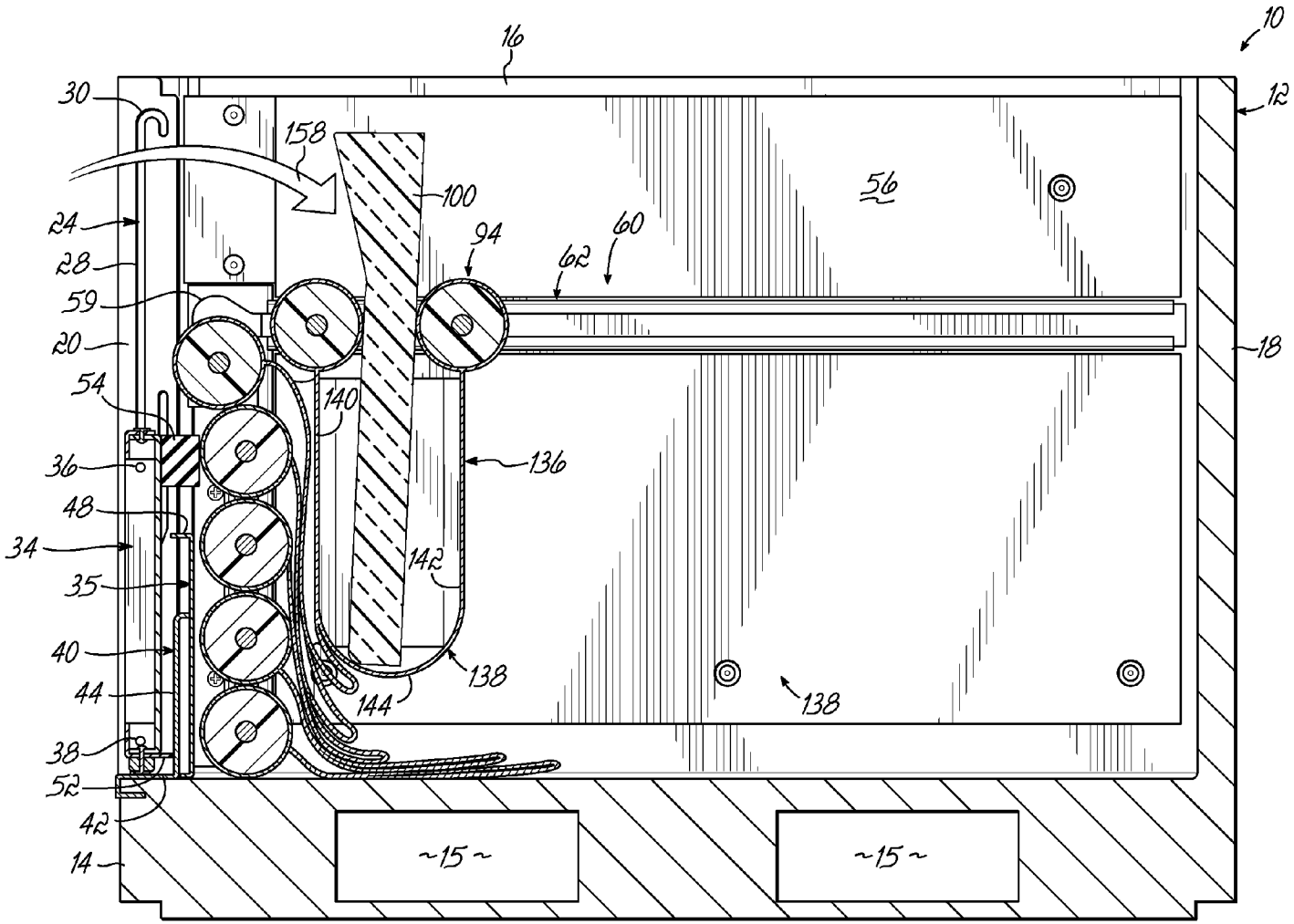
FIG. 5A is a cross-sectional view of a portion of the container of FIG. 1, showing a product being inserted into a rear pouch.

FIGS. 5A-5F illustrate a method of loading product 100 into the pouches 138 of emptied container 10. As shown in FIG. 5A, the first step of the loading process comprises loading a product 100 into rear pouch 138 (furthest away from the front of the container) in the direction of arrow 158.

Figure 5B:
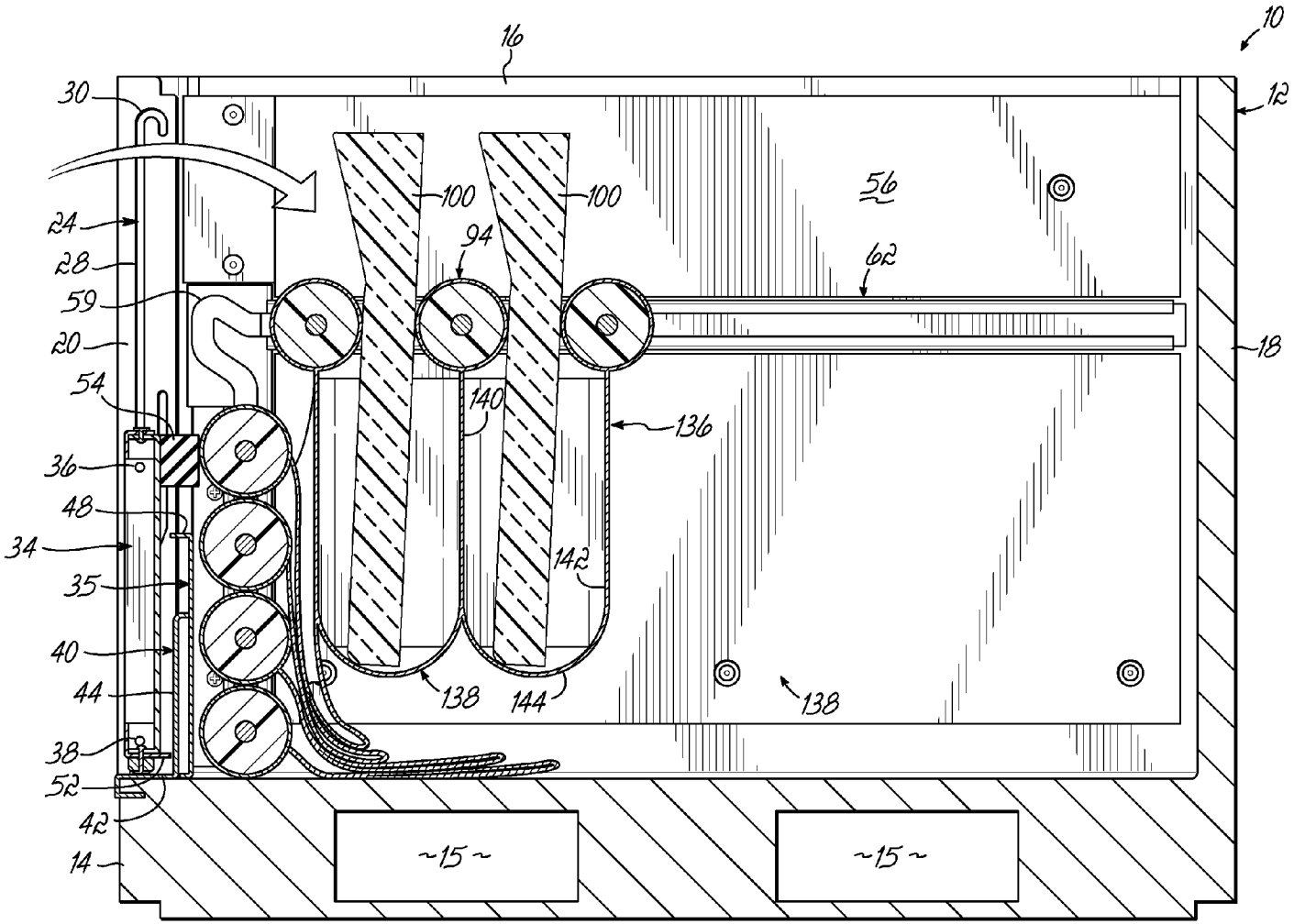
FIG. 5B is a cross-sectional view of a portion of the container of FIG. 1, showing a second product being inserted into a pouch.
Figure 5C:
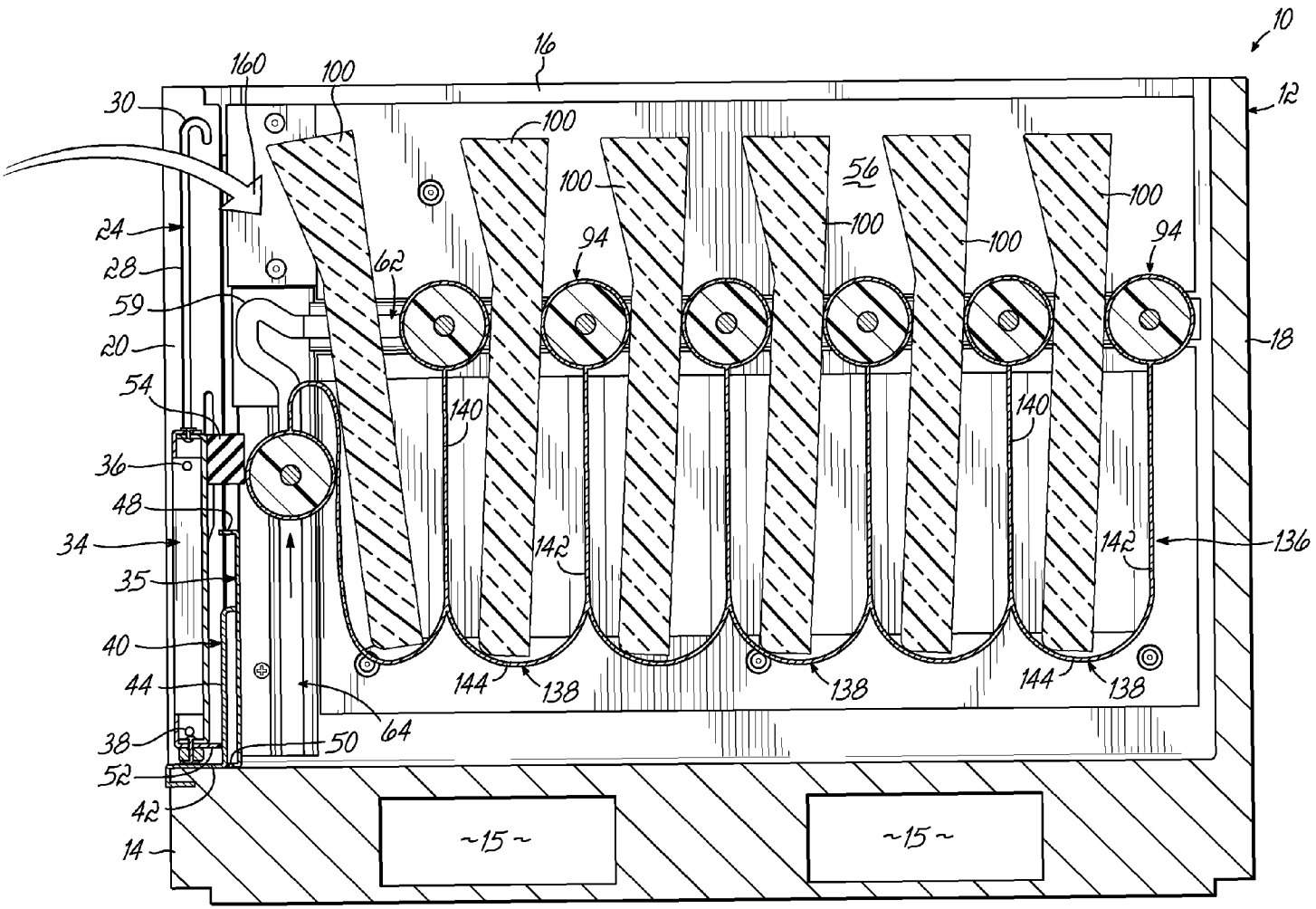
FIG. 5C is a cross-sectional view of a portion of the container of FIG. 1, showing a product being inserted into a front pouch.

As shown in FIG. 5B, the next step comprises moving padded dunnage supports 94 supporting the loaded pouch 138 towards the rear of the container, the end members 98 of padded dunnage supports 94 moving along the generally horizontally oriented track portions 62 of generally L-shaped tracks 60, the loaded rear pouch 138 containing a product 100. The process of loading one pouch at a time continues until each pouch 138 is full. FIG. 5C illustrates an operator (not shown) loading a product 100 into front pouch 138 (closest to the front of the container) in the direction of arrow 160.

Figure 5D:
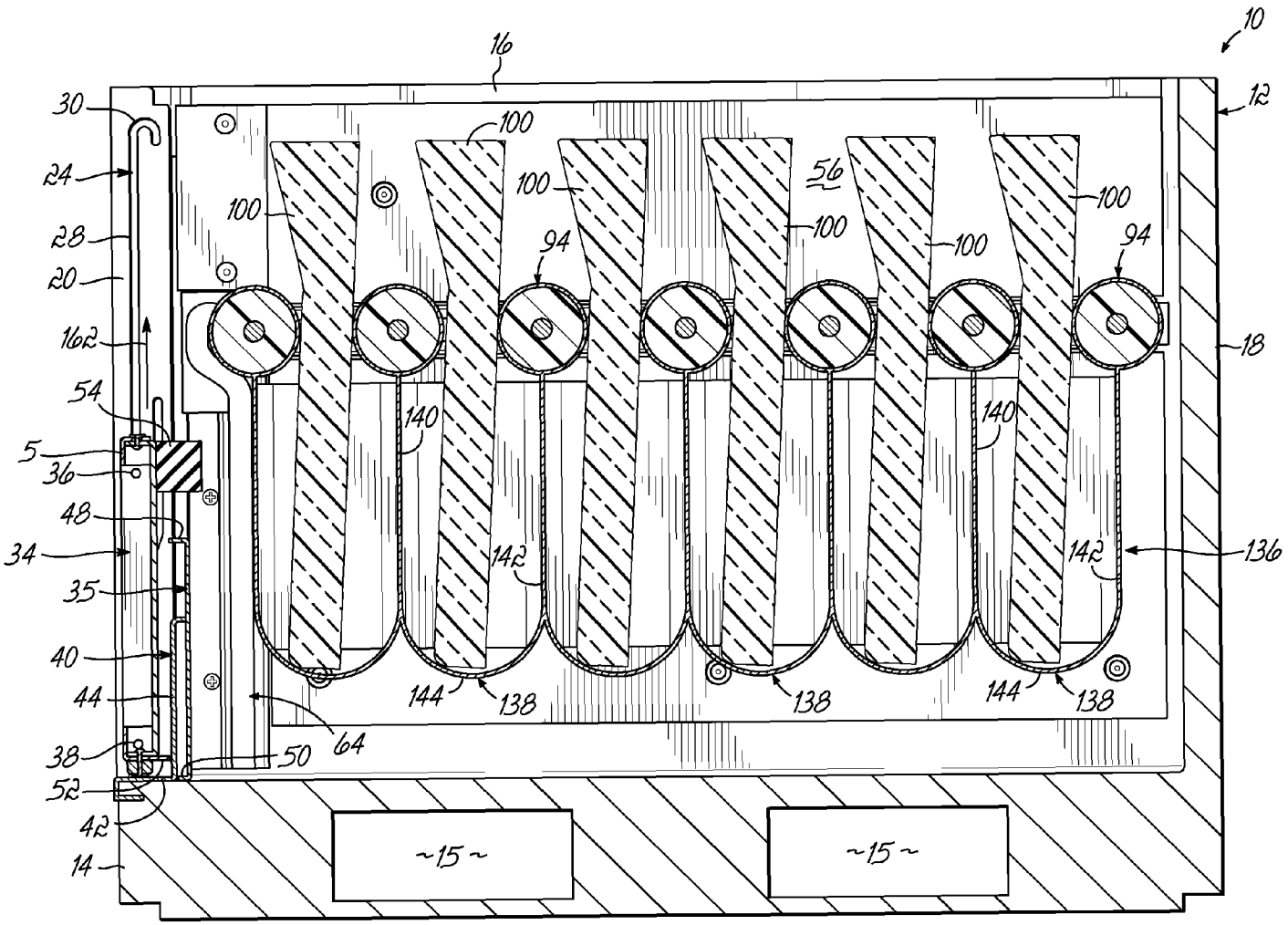
FIG. 5D is a cross-sectional view of a portion of the container of FIG. 1, showing the door assembly being raised.
Figure 5E:
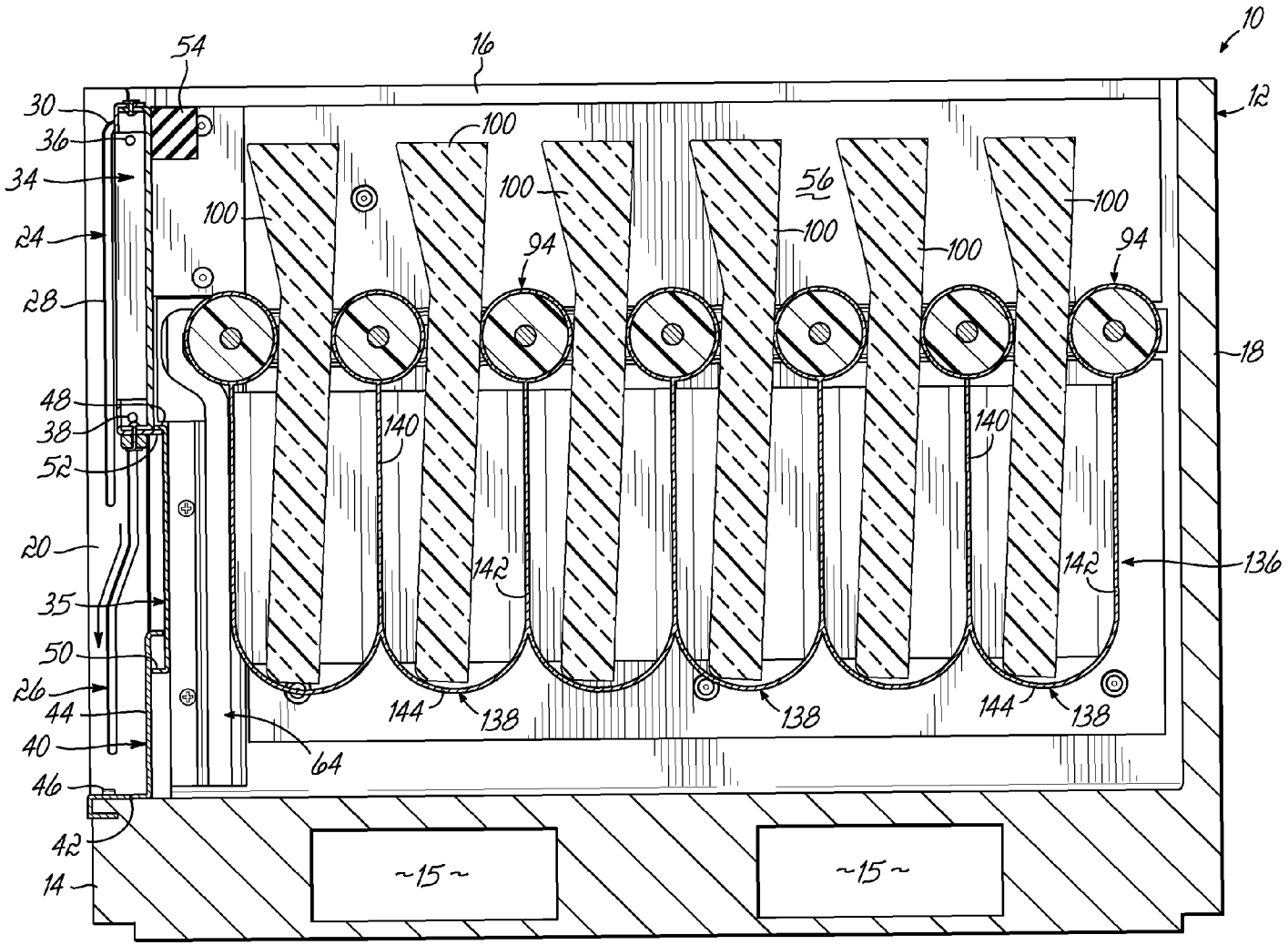
FIG. 5E is a cross-sectional view of a portion of the container of FIG. 1, showing the container fully loaded and ready for shipment.

As shown in FIG. 5D, the next step comprises raising the front padded dunnage support 94 inside the generally vertically oriented track portions 64 of generally L-shaped tracks 60 upwardly around the curved portions or inhibitors 59 and into the generally horizontally oriented track portions 62 of generally L-shaped tracks 60.

As shown in FIG. 5D, the next step comprises raising the door assembly 32 in the direction of arrow 162 to its raised and locked position. Once all of the pouches 138 have been loaded with product 100, and the door assembly 32 fixed in its raised and locked position shown in FIG. 5E, the full container may be shipped to its desired destination.

Although one specific shape of product 100 is illustrated in the drawings, this document is not intended to limit in any way the size, shape or configuration of product shipped or stored in any of the embodiments described or shown herein.

While various embodiments of the present invention have been illustrated and described in considerable detail, it is not the intention of the applicant to restrict or in any way limit the scope of the claims to such detail. Additional advantages and modifications will readily appear to those skilled in the art. The invention in its broader aspect is, therefore, not limited to the specific details, representative system, apparatus, and method, and illustrative examples shown and described. Accordingly, departures may be made from such details without departing from the spirit or scope of the applicant's general inventive concept.

What is claimed is:

1. A container for holding product therein during shipment, the container comprising:

a base and opposed sides;

non-linear tracks supported by each side of the container;

a plurality of padded dunnage supports movable along the tracks; and pouches supported by the padded dunnage supports.

2. The container of claim 1 wherein each of the non-linear tracks is generally L-shaped.

3. The container of claim 1 wherein at least one of the non-linear tracks has an inhibitor to aid in maintaining the padded dunnage supports in positions extending between generally horizontally oriented portions of the non-linear tracks.

4. The container of claim 1 wherein the base and sides are part of a pallet box.

5. The container of claim 1 wherein each of the padded dunnage supports comprises end members movable along corresponding tracks and a middle member extending between the end members, the middle member being at least partially surrounded by a cushioning sleeve.

6. The container of claim 1 wherein each of the padded dunnage supports comprises a foam sleeve at least partially surrounding a dunnage support.

7. A container for holding product therein during shipment, the container comprising:

a base and two opposed sides;

at least one non-linear track supported by each side of the container;

a plurality of padded dunnage supports extending between opposed tracks and being movable along the tracks; and dunnage supported by the padded dunnage supports.

8. The container of claim 7 wherein at least one of the non-linear tracks is generally L-shaped.

9. The container of claim 8 wherein each of the non-linear tracks is generally L-shaped.

10. The container of claim 7 wherein each of the padded dunnage supports comprises a padded sleeve surrounding a tubular member.

11. The container of claim 7 wherein at least one of the padded dunnage supports comprises a foam sleeve around a tubular member.

12. The container of claim 7 wherein at least one of the non-linear tracks has an inhibitor to maintain the padded dunnage supports in positions extending between generally horizontal portions of the non-linear tracks.

13. The container of claim 7 wherein each of the padded dunnage supports comprises two end members joined by a middle member.

14. The container of claim 7 wherein the dunnage comprises pouches.

15. The container of claim 7 wherein the base and opposed sides are made of plastic.

16. A container for holding product therein during shipment, the container comprising:

a base and opposed sides;

a non-linear track supported by each of the opposed sides;

a plurality of padded dunnage supports extending between opposed tracks and being movable along corresponding tracks, each of the padded dunnage supports comprising an outer padding layer; and pouches supported by the padded dunnage supports.

17. The container of claim 16 wherein each of the padded dunnage supports comprises a pair of end members and a middle member extending between the end members.

18. The container of claim 16 wherein the padding layer is foam.

19. The container of claim 16 wherein each non-linear track is generally L-shaped.

20. The container of claim 16 wherein at least one of the non-linear tracks has an inhibitor to maintain the padded support members in positions extending between generally horizontal portions of the non-linear tracks.

* * * * *